United States Patent [19]

Zenss

[11] Patent Number: 4,484,416

[45] Date of Patent: Nov. 27, 1984

[54] SUPPORT FOR MOUNTING SPECTACLES

[76] Inventor: Fritz Zenss, Moltkestrasse 8, 7031 Gartringen, Fed. Rep. of Germany

[21] Appl. No.: 373,879

[22] Filed: May 3, 1982

[30] Foreign Application Priority Data

May 7, 1981 [DE] Fed. Rep. of Germany ..... 3118026

[51] Int. Cl.[3] ..... B24B 41/06

[52] U.S. Cl. ..... 51/217 R; 51/164.5; 269/45; 269/152; 269/7

[58] Field of Search ..... 51/164.5, 163, 164.2, 51/7, 217 R; 269/104, 152, 43, 45

[56] References Cited

U.S. PATENT DOCUMENTS

| | | | |
|---|---|---|---|
| 853,426 | 5/1907 | Steenstrup | 269/45 |
| 2,806,495 | 9/1957 | Merkle | 269/45 |
| 3,386,727 | 6/1968 | Lind | 269/152 |
| 3,394,389 | 7/1968 | Amir | 269/45 |
| 3,527,454 | 9/1970 | Humm | 269/45 |

FOREIGN PATENT DOCUMENTS

| | | | |
|---|---|---|---|
| 2202294 | 7/1973 | Fed. Rep. of Germany | 51/164.1 |

*Primary Examiner*—Harold D. Whitehead

*Attorney, Agent, or Firm*—M. Robert Kestenbaum

[57] ABSTRACT

A metallic crossbar device has mounting means for the end regions of spectacle frame yokes and space for a number of adjacent spectacle frames oriented in about the same direction. The cross-bar device comprises two crossbars which run parallel to each other and are spaced apart at a distance corresponding to the spacing of the end regions of the spectacle frame yokes. The crossbars have cross yokes at their end regions which rigidly connect the crossbars together. Each of the crossbars comprises two adjacent, flexurally stiff partial bars and clamping means for clamping one partial bar like a vice against an adjacent partial bar. The partial bars have a maximum clamping height which corresponds to the unprocessed length of the spectacle frame yoke end regions. Both partial bars have strip-shaped plastic clamping linings on their sides adjacent each other.

11 Claims, 4 Drawing Figures

SUPPORT FOR MOUNTING SPECTACLES

The invention relates to a support for mounting metallic spectacle frames in polishing drums, with a metallic crossbar device and with a respective mounting for each end region of the spectacle frame, the support having room for a number of spectacles oriented adjacently and in about the same direction.

Such spectacles always have a bridge, lens edges closed by a closing block including screw, and yokes linked by hinges to the lens edges. The end region of the yoke is later pushed into plastics sleeves.

BACKGROUND OF THE INVENTION

The spectacle frames, without the pads, without lenses and without the ear sleeves, are polished smooth for a few hours in polishing drums. In this finished state, the end regions of the spectacle yokes are still straight, i.e. not bent corresponding to the later ear shape.

The spectacle frames are held, according to a prior art process, in such a support of respectively 9 pieces. The support consists of a box profile, which has respective arms to right and left. Each arm merges at its end into a ring, which has a diameter in the centimeter range. The end regions of the spectacle yokes are located within these rings. At the upper side are provided ten punch pins which likewise carry a ring at their ends, which however is substantially smaller than the previously mentioned ring. A plastics loop is slipped through these rings and is held festoon-like by the rings. The low point of each festoon acts as a support for the interior side of the bridge of the spectacle frame.

So that the spectacle frames do not float away in the polishing medium, a fixing bar is also put through the smaller rings above the bridges; it is as long as the box profile. So that this securing bar does not itself float away, it is secured. This construction has the following disadvantages:

(a) The flow resistance which this support exerts on the polishing medium is relatively high.

(b) Only a completely determined number of spectacle frames can be polished, quite independently of whether they are large or small.

(c) The bridge of the spectacle frame is indeed held on one side by the plastics loop and on the other side by the securing pin. The bridge is therefore always insufficiently processed and frequently even scratched, because polishing medium particles penetrate between the bridge and the securing rod and/or the plastics loop. This leads to reprocessing.

(d) The plastics loop must be frequently changed, because the polishing medium abrades the plastics. Apart from this, those rings which hold the end regions of the spectacle frame yoke, are clad with a plastics sheathing. Even this is abraded and must be frequently changed.

(e) Every polishing is associated with vibrations. The screws of the closing blocks therefore often loosen during use of the known support. If the screws have fallen out, the lens edge can be bent, since in fact the polishing medium flows onto it from below. It is conjectured that the lens edge screws open because the vibrations of polishing lead to knee-like movements of the lens edge.

(f) The production of the support is expensive.

SUBJECT AND STATEMENT OF THE INVENTION

The object of the invention is to specify a support of the kind stated at the beginning, which no longer has the abovenamed disadvantages and in particular makes reprocessing superfluous, is cheap to produce, has a long useful life and with which it is possible to polish the optimum number of spectacle frames. At the same time, the supports are to be at least as easily manipulated as the known supports during loading and unloading of spectacle frames.

According to the invention, this object is achieved by the following features:

(a) The crossbar device comprises two crossbars which run mutually parallel and are spaced apart at a distance corresponding to the spacing of the end regions of the spectacle yokes, and their end regions are rigidly connected together by cross-yokes.

(b) Each crossbar comprises two adjacent, flexurally stiff partial bars, a respective partial bar being able to be clamped against the neighboring one by clamping means, in the manner of a vise.

(c) The partial bars have at most a clamping height which corresponds to the unprocessed length of the spectacle yoke end regions.

Advantageously, the invention includes the following additional features:

Said partial bars have substantially I-profiles. By means of these features, the flexural stiffness in the direction of stress is increased and the resistance to flow is reduced. Apart from this, the polishing medium particles then float, directly after the clamp, against the spectacle frame yokes again, and a minimum flow shadow arises.

At least one partial bar has on its inner side a strip-shaped clamping lining of plastic material, the plastic material being considerably softer than the metal of the spectacle yoke. Preferably, both partial bars have strip-shaped plastic clamping linings on their sides adjacent each other. By means of these features, the end regions of the spectacle yokes are gently but securely held.

The plastic material is connected securely as a lining to its associated partial bar. By means of these features, only the accompanying partial bar needs to be pulled somewhat away from the other partial bar during releasing, and the lining then also moves and the slot is visible in which the end regions of the spectacle yokes must be placed. This is substantially more favorable than a per se likewise possible loose association of the plastics material with the partial bar.

The plastic material is continuous and has an I-profile. By means of these features, the plastics material is equally well packed at all places, and care need not be taken as to where the end regions are inserted.

One of said adjacent partial bars has a passage hole and the other of said adjacent partial bars has an aligned threaded hole and said clamping means comprises wing bolts, the shaft of which passes through said passage hole of one partial bar and is screwed into said threaded hole of said other partial bar, and said clamping means is adapted to permit a greater gap between said partial bars than the thickness of the end regions of the spectacle frame yokes. By means of these features, no tools are needed, and in practical cases partial bars about 440 mm long, with three wing bolts each, are sufficient. The plastics material distributes the clamping force better than would be the case with metal-to-metal clamping.

One of said partial bars is an inner partial bar which merges integrally into said cross-yoke and forms said cross-yoke. By means of these features, the cross-yokes can easily be produced by bending the inner partial bars aside.

The parting plane of two adjacent partial bars forms an acute angle with the mid symmetry plane of the support. By means of these features, those spectacle frames can be polished, without the appearance of additional stresses, which have the spectacle yokes likewise forming acute angles. Apart from this, also, the hinge regions of the spectacle yokes, seen in projection, do not lie in the flow shadow.

One of said partial bars is as inner partial bar having an inside bevel in its corner region arranged to be placed upstream and inside in the polishing drum. By means of these features, a certain elasticity is produced in this region, and also it becomes more favorable to flow.

Said clamping means comprises a quick clamping device.

DESCRIPTION OF THE DRAWINGS

The invention will now be described with reference to a preferred example of an embodiment. In the drawing there are shown.

DETAILED DESCRIPTION

Figure 1:
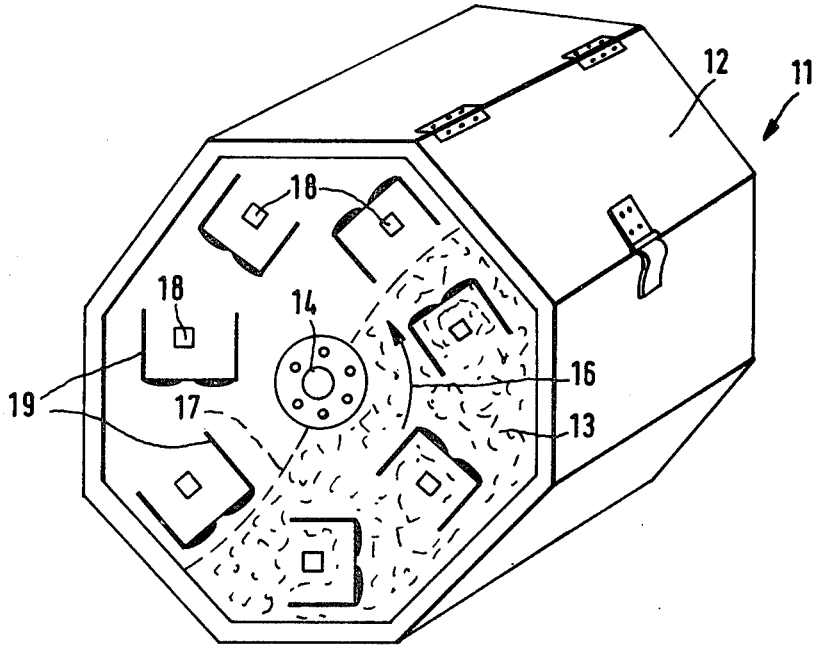
FIG. 1 a schematic view of a polishing drum with opened front floor.

A polishing drum 11 has a hexagonal periphery and, correspondingly, six divisions. One of the divisions 12 can be opened and closed. Polishing medium can be introduced through this division. The polishing drum is closed by floors on both sides. The front floor is omitted to schematically show internal processes [sic]. The polishing drum 11 is mounted on bearings 14, and a drive tends to move it in the direction of the arrow 16. When the polishing drum 11 is running, the polishing medium 13 assumes the shape of a wave 17 which, as in FIG. 1, is slightly S-shaped. The polishing medium 13 remains standing there, i.e., it does not move along with the polishing drum 11. Mountings 18 are provided, respectively in pairs, in the floor of the polishing drum 11, and the orientation of spectacle frame holders 19 is respectively schematically shown. It can be seen from this that the polishing medium 13 pushes through them.

In the mountings 18 there are seated releasably, though fixed—and in particular, fixed against rotation—metallic squares 21, 22, through which passes the mid symmetry plane 23 of a support 24. These floatingly arranged squares 21, 22 are welded on their mutually facing sides to respective carrier plates 26, 27, which are flush at the top with the related square 21, 22.

Respective yoke halves 28, 29, 31, 32 are welded on overlappingly at the lower, internal region of the carrier plates 26, 27, which lie symmetrically of the mid symmetry plane 23. The yoke halves do not run horizontally. On the contrary, they make an angle of 8°, falling away to left and right, with the mid symmetry plane 23. The yoke halves are about 60 mm long, and have an I-profile, which lies parallel to the direction of the arrow 16. The yoke halves 28, 31 are the ends, bent around through 90° in a U-shape, of a partial bar 33. The like partial bar 34 originated in the same manner. The partial bars 33, 34 are about 460 mm long, are of an I-profile, and form with the mid symmetry plane 23 an angle of 8° respectively along mid planes 56. Both have a chamfer 36, 37 at their inner, downstream corner region. Furthermore, both have four threaded holes 38, respectively spaced 120 mm apart and provided centrally in the height of the I-profile.

Respective rubber linings 39, 41 are adhered externally to the partial bars 33, 34, cover the whole external surface of the partial bar 33, 34, and have through holes where the threaded holes 38 are located. Like rubber linings 42, 43 abut against, but are not adhered fast to, the rubber linings 39, 41. On the contrary, they are adhered fast to the inner side of the partial bars 44, 46 which form, with the opposite partial bars 33, 34 a kind of long vise. The partial bars 44, 46 have through holes 47 aligned with the threaded holes 38 and with bolts passing through them which can be tightened from outside by means of wing bolts 49 and thus press the rubber linings 39, 41, 42, 43 against each other. The partial bars 44, 46 have the same cross section as the partial bars 33, 34, but are only 440 mm long, since a remainder is left over for bending aside between the yoke halves 28, 29, 31, 32 and the partial bars 33, 34.

The rubber linings 39, 41, 42, 43 are about 1 mm thick. The partial bars are 25 mm high and 4 mm thick.

Figure 3:
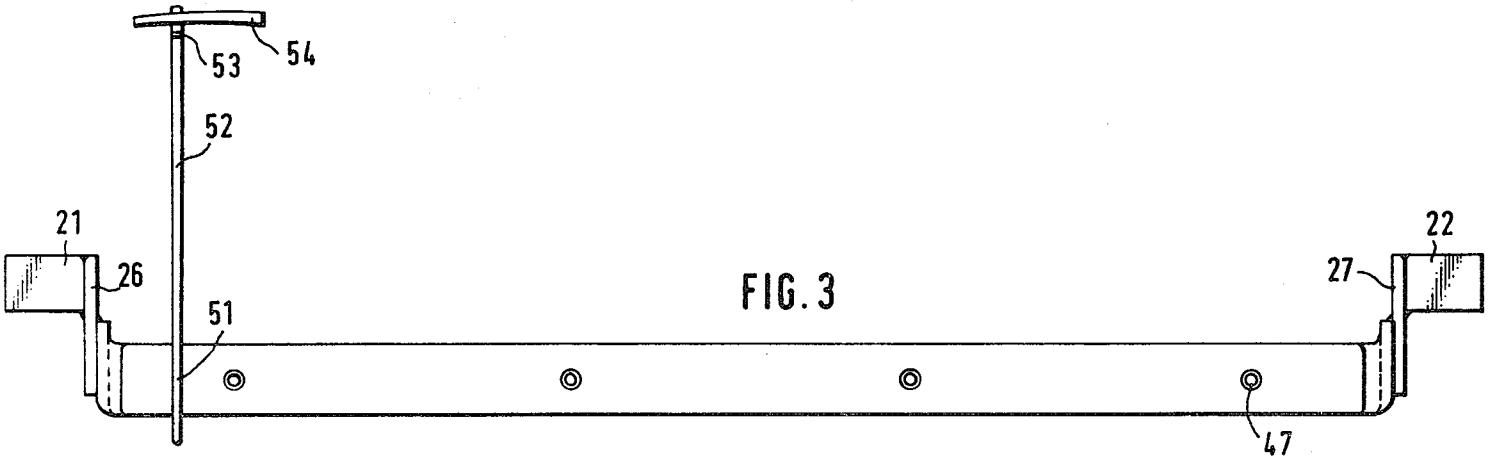
FIG. 3 the side view of FIG. 2.
Figure 2:
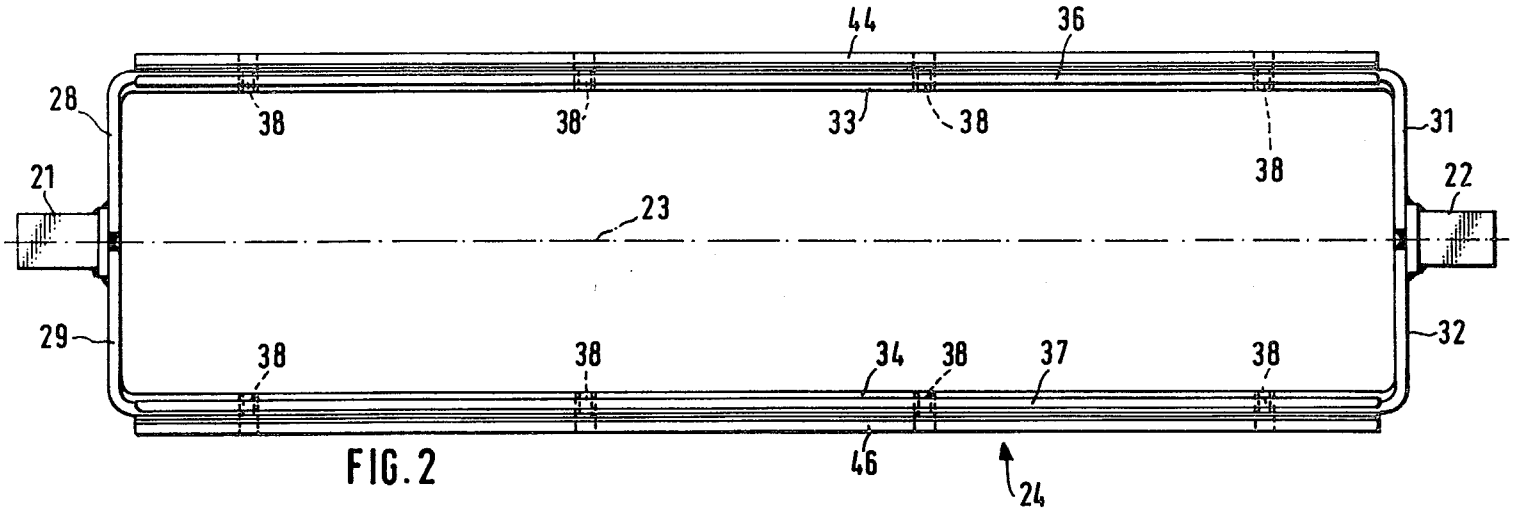
FIG. 2 the plan view of a support.
Figure 4:
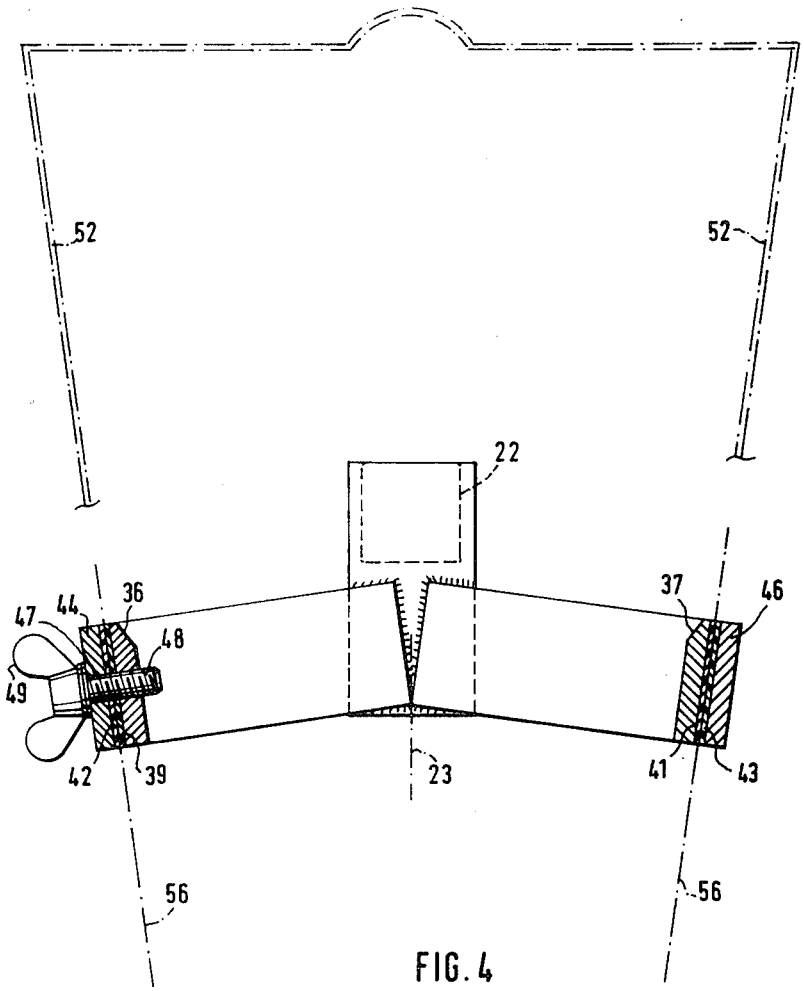
FIG. 4 the end view of FIG. 2.

In operation, the bolts 48 are first released, so that a gap arises between the rubber linings 42, 39 on the one side and 41, 43 on the other side. End regions 51 of spectacle yokes 52 are placed between them, which are attached by hinges 53 to lens edges 54. When beginning with the arrangement according to FIG. 3, the bolt lying further to the right can be opened up more than the bolt lying further to the left, and the more the support 24 is filled from left to right, the screws are also tightened from left to right also. A spectacle frame can now be arranged next to the others, or can be arranged at a different height, or can even be arranged at a different angle as seen in the direction of FIG. 3. The lower tips of the end regions 51 can then project out downwards to some extent.

Because of the 8° angle, the spectacle yokes 52 run at the same angle.

I claim:

1. In a support for mounting spectacle frames in polishing drums, comprising a metallic crossbar device with mounting means for the end regions of spectacle frame yokes, said support having space for a number of adjacent spectacle frames oriented in about the same direction, the improvement wherein:

(a) said crossbar device comprises two crossbars which run parallel to each other and are spaced apart at a distance corresponding to the spacing of the end regions of the spectacle frame yokes, and said crossbars have end regions and have cross yokes at said end regions which rigidly connect said crossbars together at a mid symmetry plane of said cross bar device;

(b) each of said crossbars comprises two adjacent, flexurally stiff partial bars and clamping means for clamping one partial bar like a vise against an adjacent partial bar;

(c) said partial bars have a maximum clamping height which corresponds to the unprocessed length of the spectacle frame yoke end regions and (d) the said mid plane of two adjacent partial bars forms an acute angle with said mid symmetry plane of said cross bar device.

2. A support according to claim 1, wherein said partial bars have substantially I-profiles.

3. A support according to claim 1, wherein at least one partial bar has on its inner side a strip-shaped clamping lining of plastic material, the plastic material being considerably softer than the metal of the spectacle yoke.

4. A support according to claim 3 wherein both partial bars have strip-shaped plastic clamping linings on their sides adjacent each other.

5. A support according to one of claims 3 or 4 wherein the plastic material is connected securely as a lining to its associated partial bar.

6. A support according to one of claims 3 or 4 wherein the plastic material is continuous and has an I-profile.

7. A support according to claim 1, wherein one of said adjacent partial bars has a passage hole and the other of said adjacent partial bars has an aligned threaded hole and said clamping means comprises wing bolts, the shaft of which passes through said passage hole of one partial bar and is screwed into said threaded hole of said other partial bar, and said clamping means is adapted to permit a greater gap between said partial bars than the thickness of the end regions of the spectacle frame yokes.

8. A support according to claim 1, wherein one of said partial bars is an inner partial bar which merges integrally into said cross-yoke and forms said cross-yoke.

9. A support according to claim 1, wherein one of said partial bars is as inner partial bar having an inside bevel in its corner region arranged to be placed upstream and inside in the polishing drum.

10. A support according to claim 1, wherein said clamping means comprises a quick clamping device.

11. A support according to claim 4, wherein one of said adjacent partial bars has a passage hole and the other of said adjacent partial bars has an aligned threaded hole and said clamping means comprises wing bolts, the shaft of which passes through said passage hole of one partial bar, passes through said plastic clamping linings, and is screwed into said threaded hole of said other partial bar, and said clamping means is adapted to permit a greater gap between said clamping linings than the thickness of the end regions of the spectacle frame yokes.

* * * * *